United States Patent [19]

Goussios

[11] Patent Number: 4,953,895

[45] Date of Patent: Sep. 4, 1990

[54] DUAL PURPOSE LOTTERY TICKET AND BOARDING PASS

[75] Inventor: Theodore Goussios, Sarasota, Fla.

[73] Assignee: Inspiration Markets, Inc., Sarasota, Fla.

[21] Appl. No.: 354,924

[22] Filed: May 22, 1989

Related U.S. Application Data

[63] Continuation-in-part of Ser. No. 332,694, Apr. 3, 1989, abandoned.

[51] Int. Cl.[5] ..... B42D 15/00; A63F 3/06; A63F 3/08

[52] U.S. Cl. ..... 283/102; 283/23; 283/903; 273/139

[58] Field of Search ..... 283/102, 23, 903, 53, 283/56; 273/138 R, 139

[56] References Cited

U.S. PATENT DOCUMENTS

| | | | |
|---|---|---|---|
| 2,309,398 | 1/1943 | Keller | 283/53 |
| 2,999,698 | 9/1961 | Hoese | 283/903 |
| 3,181,868 | 5/1965 | Markle et al. | 273/139 |
| 4,203,240 | 5/1980 | Goodwin | 283/56 X |
| 4,630,844 | 12/1986 | Troy et al. | 283/67 |
| 4,725,077 | 2/1988 | Fujita | 283/67 |
| 4,817,949 | 4/1989 | Bachman et al. | 273/139 |

*Primary Examiner*—Yost Frank T.
*Assistant Examiner*—Eugenia A. Jones
*Attorney, Agent, or Firm*—Charles J. Prescott

[57] ABSTRACT

A dual-purpose lottery play ticket and boarding pass issued by a commercial passenger carrier to each passenger boarding an aircraft for commercial flight. The invention comprises two parts, the first part of which is to be retained by the air carrier upon boarding, while the second part of which is to be retained by each passsenger. Both first and second parts include data printed thereon describing each passenger by name and/or frequent flyer number, and information to finding a particular schedule flight designation. Both parts also include identical lottery play indicia printed thereon so that each passenger has the opportunity to enter a lottery sponsored by the air carrier By each party retaining a properly validated part of the invention, proof of entry and selection are secured. The preferred form of the invention envisions each passenger making a lottery number selection in conjunction with boarding the aircraft; however, a random lottery number selection may also be preprinted on each part, random number selection thereafter by the air carrier still determining winners in either event.

4 Claims, 1 Drawing Sheet

DUAL PURPOSE LOTTERY TICKET AND BOARDING PASS

BACKGROUND OF THE INVENTION

This application is a continuation-in-part application of Ser. No. 07/332,694, filed on Apr. 3, 1989 and abandoned.

This invention relates generally to lottery game devices, and more particularly to a dual purpose lottery play ticket and boarding pass to promote airline travel.

Lotteries have become extremely popular in this country as well as worldwide, as witnessed by numerous state lotteries now successfully in place in this country. Various devices and apparatus are the subject of prior art known to applicant which take advantage of this gambling psychology. One such device is disclosed in U.S. Pat. No. 4,817,949 to Bachman which is directed to an A.T.M. which dispenses lottery play tickets as well as cash. Another device known to applicant is disclosed in U.S. Pat. No. 1,567,560 to Worth which teaches a unique apparatus for playing parlor games. One additional prior art device known is disclosed in U.S. Pat. No. 4,453,664 invented by Oliff which teaches a dual purpose beverage bottle carrier which includes a detachable two-part lottery coupon.

The present invention discloses a dual purpose lottery play ticket and airline boarding pass which an air carrier may conveniently use for promoting its commercial passenger carrying services. The device, in addition to functioning as a conventional two-part boarding pass, also facilitates selection of a lottery number, the entry of which into each lottery effected by validating the boarding pass upon boarding an aircraft.

BRIEF SUMMARY OF THE INVENTION

This invention is directed to a dual-purpose lottery play ticket and boarding pass issued by a commercial passenger carrier to each passenger boarding an aircraft for commercial flight. The invention comprises two parts, the first part of which is to be retained by the air carrier upon boarding, while the second part of which is to be retained by each passenger. Both first and second parts include data printed thereon describing each passenger by name and/or frequent flyer number, and information to finding a particular schedule flight designation. Both parts also include identical lottery play indicia printed thereon so that each passenger has the opportunity to enter a lottery sponsored by the air carrier. By each party retaining a properly validated part of the invention, proof of entry and selection are secured. The preferred form of the invention envisions each passenger making a lottery number selection in conjunction with boarding the aircraft; however, a random lottery number selection may also be preprinted on each part, random number selection thereafter by the air carrier still determining winners in either event.

It is therefore an object of this invention to provide a dual purpose boarding pass and lottery play ticket which may be utilized by a commercial passenger airline to promote revenues.

It is another object of this invention to provide a combination boarding pass and lottery play ticket having various embodiments to facilitate mode of implementation selection.

In accordance with these and other objects which will become apparent hereinafter, the instant invention will now be described with reference to the accompanying drawings in which:

DETAILED DESCRIPTION OF THE INVENTION

Figure 1:
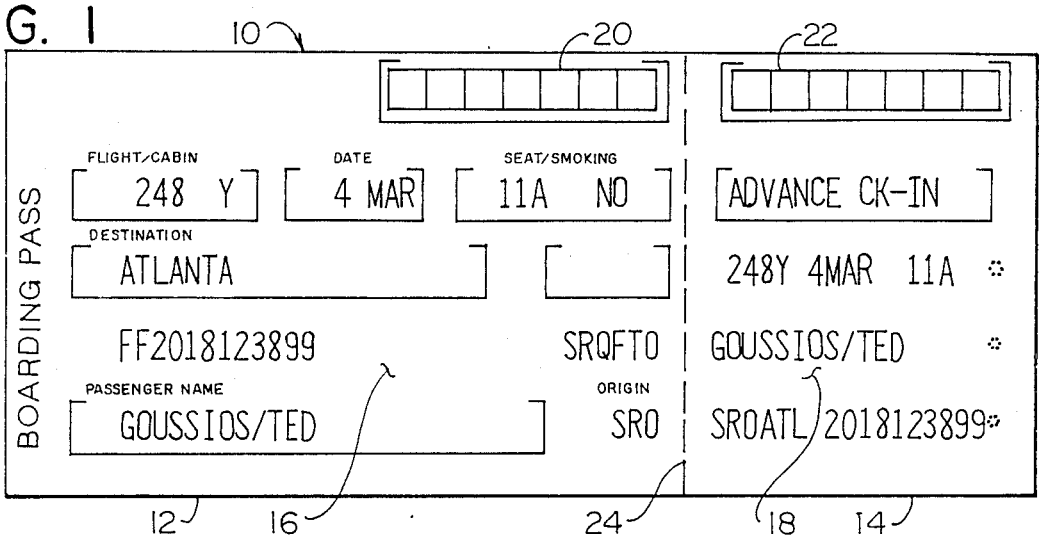
FIG. 1 is a top plan view of one embodiment of the invention.

Referring now to the drawings, and particularly to FIG. 1, the preferred embodiment of the invention is shown generally at numeral 10 and includes a two-part or combination boarding pass and lottery play ticket having a first part 12 and a second part 14, respectively which are detachable one from another along perforated line of weakness 24. Both first and second parts 12 and 14 include similar viewable indicia 16 and 18, respectively printed thereon which describes each passenger by name and/or frequent flyer number, and information defining a particular scheduled flight designation as shown.

In use, the boarding pass 10 is utilized to validate passenger boarding by examining the pass at the time each passenger enters an aircraft, the first part 12 being retained by the airline while the second part 14 being retained by the passenger, each verifying proof of travel.

To promote revenues of the air carrier, also printed on each part 12 and 14 of each boarding pass 10 is an array of spaces 20 and 22 printed and defined thereon. These arrays of spaces 20 and 22 include a plurality of boxes as shown which are of sufficient size to have a number or letter written within each separate defined box within each array of spaces 20 and 22. These numbers are viewable indicia are to be written in by each passenger representing his selection in a lottery established by the air carrier. Of course, each set of selected numbers written into array 20 are envisioned as being the same as that written into array 22. Thereafter, the air carrier will randomly select a winning number in accordance with conventional lottery number selection procedures and the winning passenger may check and verify his numbers based upon the viewable numbers written into array 22 of second part 14. An alternate form of the invention 10 as shown in FIG. 1 is in the form of preprinted randomly selected numbers within each box of arrays 20 and 22. These preselected random numbers would appear identical within each array 20 and 22, the lottery selection also being random from the group of numbers consisting of those preprinted within arrays 20 and 22.

Figure 2:
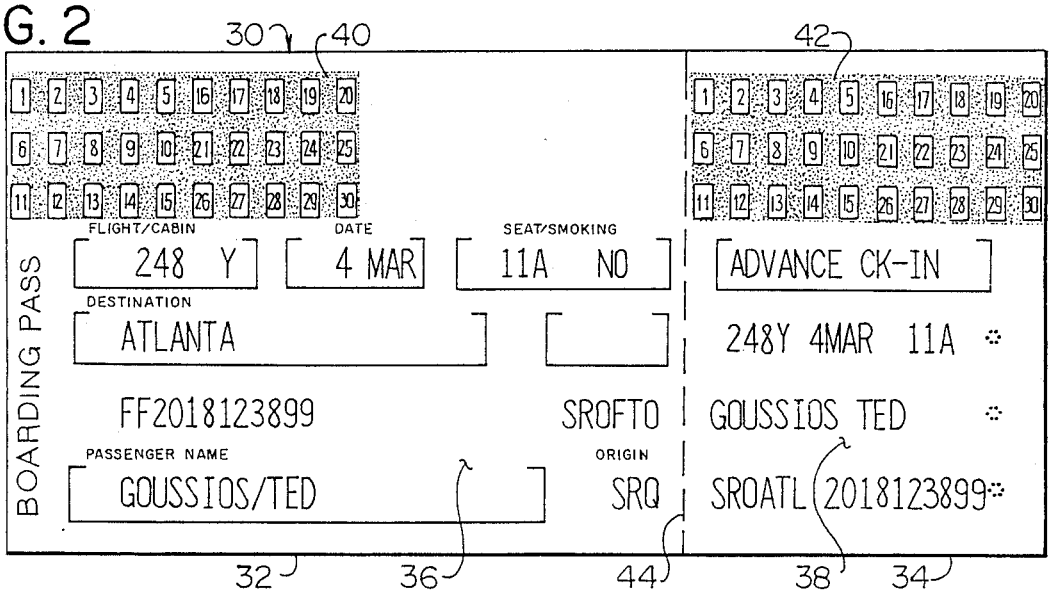
FIG. 2 is a top plan view of another embodiment of the invention.

Referring now to FIG. 2, another embodiment of the invention is shown generally at numeral 30 and also includes a first part 32 and a second part 34 having printed indicia 36 and 38 describing the passenger and the flight designation as previously described with regard to FIG. 1. Likewise, the first and second part 32 and 34 are separable along a perforated line of weakness 44.

This embodiment 30 also includes a means for playing a lottery. However, in this embodiment, the structure provided for playing a lottery is in the form of two identical arrays of preprinted, ordered, and sequenced numbers 40 and 42 printed on each of the first and second parts 32 and 34, respectively.

To use this embodiment 30, the user simply marks his selection of a predetermined quantity of numbers shown in each array 40 and 42 as with a permanently indelible pencil or pen or by hole punching. Again, the selection of numbers in array 40 must be identical to that in array 42 so that each part 32 and 34 serves as independent proof of the selection. As previously described, the air carrier then selects the winning numbers from the array consisting of the numerals contained within the identical arrays 40 and 42, here numerals 1 to 30 as shown by way of example only.

Figure 3:
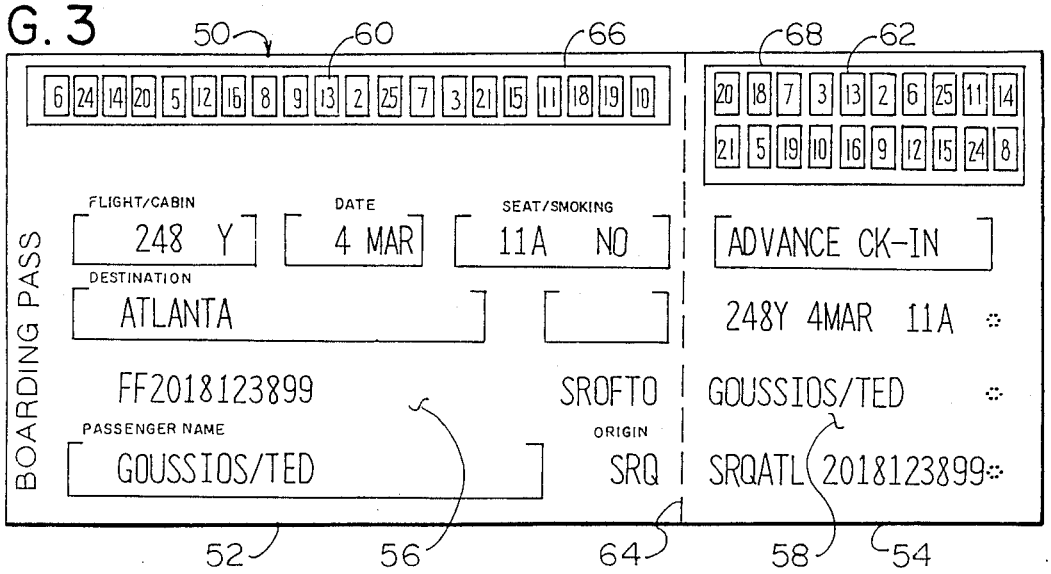
FIG. 3 is a top plan view of another embodiment of the invention.

Referring lastly to FIG. 3, another embodiment of the invention is shown at numeral 50 and includes passenger and flight designation indicia 56 and 58 on first and second parts 52 and 54, respectively, of the boarding pass 50 as previously described. Again, the first and second parts 52 and 54 are separable along perforated line of weakness 64.

In this embodiment 50, two identical arrays of non-sequenced, randomly selected number 60 and 62 are disposed on the first and second parts 52 and 54, respectively of boarding pass 50. Each of these arrays 60 and 62 are covered by a thin, opaque, continuous coating over each array 60 and 62 so that none of the numbers are viewable prior to selection at boarding. Various techniques of coating selection are available to insure against unauthorized viewing of those numbers 60 and 62 below these coatings 66 and 68. For convenience, the coatings 66 and 68 are shown in perimeter form only so that the array of numerals 62 and 64 therebelow may be seen more clearly.

Thus, in use, this embodiment 50 is utilized by scratchably removing certain portions of the coatings 60 and 62 to expose a preselected quantity of the numbers contained in arrays 60 and 62. If a preselected quantity of these numbers printed and revealed by scratching on first and second parts 52 and 54 match, the passenger boarding the aircraft is an instant winner!

All embodiments of the invention are fabricated of conventional weight paper and utilize otherwise existing techniques of printing these boarding passes embodying features of the invention.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

I claim:

1. A dual-purpose lottery play ticket and air carrier boarding pass issued by a commercial passenger air carrier to each passenger boarding an aircraft for commercial flight comprising:

a paper sheet having a first part and a second part separated and partially defined by a tear line of weakness therebetween;

said first and second parts having similar viewable indicia printed thereon describing each passenger by name and information defining a particular scheduled flight designation;

said first part separable from said second part along said tear line of weakness when each passenger boards the aircraft, said first part to be retained by the air carrier for validating each person's entry into a lottery selection;

said second part to be retained by the passenger as proof of entry into the lottery and the selection made;

said first part having an array of spaces defined thereon structured for receiving a randomly selected viewable numerical lottery indicia written within each space of said array;

said second part having array of spaces defined thereon identical to the array of spaces on said first part.

2. A dual purpose lottery play ticket and aircraft boarding pass comprising:

a paper sheet having a first part and a second part separated and partially defined by a tear line of weakness therebetween;

said first and second parts having similar viewable indicia printed thereon describing each passenger by name and information defining a particular scheduled flight designation;

said first part separable from said second part along said tear line of weakness when each passenger boards the aircraft, said first part to be retained by the air carrier for validating each person's entry into a lottery selection;

said second part to be retained by the passenger as proof of entry into the lottery and the selection made;

said first part having an array of spaces defined thereon structured for receiving a randomly selected viewable numerical lottery indicia within each space of said array;

said second part having an array of spaces defined thereon identical to the array of spaces on said first part wherein said randomly selected lottery indicia are preprinted on said first and second parts.

3. A dual-purpose lottery play ticket and air carrier boarding pass issued by a commercial passenger air carrier to each passenger boarding an aircraft for commercial flight comprising:

a paper sheet having a first part and a second part separated and partially defined by a tear line of weakness therebetween;

said first and second parts having similar viewable indicia printed thereon describing each passenger by name and information defining a particular scheduled flight designation;

said first part separable from said second part along said tear line of weakness when each passenger boards the aircraft, said first part to be retained by the air carrier for validating each person's entry into a lottery selection, said second part to be retained by the passenger as proof of entry into the lottery and the selection made;

said first part having an array of ordered sequentially increasing numbers printed thereon substantially in excess of a preselected quantity of said numbers to be selected by each passenger and structured for marking a selection thereupon;

said second part also having an array of ordered sequentially increasing numbers printed thereon for marking the same selection thereupon identical to the array of numbers on said first part as evidence of the lottery number selection.

4. A dual-purpose lottery play ticket and air carrier boarding pass issued by a commercial passenger air carrier to each passenger boarding an aircraft for commercial flight comprising:

a paper sheet having a first part and a second part separated and partially defined by a tear line of weakness therebetween;

said first and second parts having similar viewable indicia printed thereon describing each passenger by name and information defining a particular scheduled flight designation;

said first part separable from said second part along said tear line of weakness when each passenger boards the aircraft, said first part having an array of non-ordered and non-sequenced numbers printed thereon substantially in excess of a preselected quantity of said numbers to be selected by each passenger;

said second part having a different array of non-ordered and non-sequenced numbers printed thereon substantially in excess of said preselected quantity of numbers;

a thin, opaque continuous coating over each said array of numbers on said first and second parts;

each said coating selectively, scratchably removable.

* * * * *